US009380396B2

(12) United States Patent
Goly

(10) Patent No.: US 9,380,396 B2
(45) **Date of Patent: *Jun. 28, 2016**

(54) HEARING INSTRUMENT WITH AN INTEGRAL INJECTION-MOLDING CASING

(75) Inventor: Volker Goly, Erlangen (DE)

(73) Assignee: Sivantos Pte. Ltd., Singapore (SG)

( * ) Notice: Subject to any disclaimer, the term of this patent is extended or adjusted under 35 U.S.C. 154(b) by 238 days.

This patent is subject to a terminal disclaimer.

(21) Appl. No.: 13/569,352

(22) Filed: Aug. 8, 2012

(65) Prior Publication Data

US 2012/0328138 A1 Dec. 27, 2012

Related U.S. Application Data

(63) Continuation-in-part of application No. 13/196,944, filed on Aug. 3, 2011.

(30) Foreign Application Priority Data

Aug. 3, 2010 (DE) ..... 10 2010 033 140
Aug. 8, 2011 (DE) ..... 10 2011 080 609

(51) Int. Cl.
*H04R 25/00* (2006.01)

(52) U.S. Cl.
CPC ..... *H04R 25/608* (2013.01); *H04R 25/652* (2013.01); *H04R 25/602* (2013.01); *H04R 25/658* (2013.01); *H04R 25/75* (2013.01)

(58) Field of Classification Search
CPC ..... H04R 25/00; H04R 25/65; H04R 25/658
USPC ..... 381/322, 323, 328, 312, 324
See application file for complete search history.

(56) References Cited

U.S. PATENT DOCUMENTS 3,749,853 A * 7/1973 Ely et al. ..... 381/313
4,657,106 A 4/1987 Hardt
4,870,688 A * 9/1989 Voroba et al. ..... 381/60
4,965,831 A * 10/1990 Schmid ..... 381/324
4,987,597 A * 1/1991 Haertl ..... 381/325

(Continued)

FOREIGN PATENT DOCUMENTS

DE 20 2004 019 744 U1 3/2005
DE 10 2009 010 376 A1 4/2010

(Continued)

*Primary Examiner* — Duc Nguyen
*Assistant Examiner* — Taunya McCarty
(74) *Attorney, Agent, or Firm* — Laurence A. Greenberg; Werner H. Stemer; Ralph E. Locher

(57) ABSTRACT

A hearing instrument has an integral injection-molding casing. The hearing instrument fixes the internal components in an integral casing that is simple in design; requires few components; and is easy to handle. The hearing instrument contains an integral casing and a frame arranged within the casing. The casing has an assembly opening through which the frame is pushed into the casing. The casing has a microphone opening oriented perpendicular to the insertion direction, which microphone opening interacts with a fixation device arranged on the frame in order to fix the frame in the casing. This provides a simple fixation mechanism. The microphone opening can be applied as a bore after the production of the casing, and therefore be produced in an injection-molding method. The fixation device can be embodied as a microphone. The microphone can be inserted into the microphone opening by a spring force.

16 Claims, 3 Drawing Sheets

(56) References Cited

U.S. PATENT DOCUMENTS

| | | | | |
|---|---|---|---|---|
| 6,752,798 | B2 * | 6/2004 | McWethy et al. | 604/506 |
| 6,959,097 | B1 | 10/2005 | Borowski | |
| 2004/0198247 | A1 * | 10/2004 | Jokinen et al. | 455/90.1 |
| 2006/0109996 | A1 * | 5/2006 | Larson et al. | 381/365 |
| 2007/0081686 | A1 * | 4/2007 | Sluppke | 381/330 |
| 2008/0128505 | A1 * | 6/2008 | Challa et al. | 235/462.13 |
| 2009/0092270 | A1 * | 4/2009 | Ho et al. | 381/324 |
| 2010/0124348 | A1 * | 5/2010 | Larson et al. | 381/365 |

FOREIGN PATENT DOCUMENTS

| | | | |
|---|---|---|---|
| EP | 0 186 748 | A2 | 7/1986 |
| EP | 0 288 822 | A1 | 11/1988 |
| WO | 2006/067133 | A1 | 6/2006 |

* cited by examiner

HEARING INSTRUMENT WITH AN INTEGRAL INJECTION-MOLDING CASING

CROSS-REFERENCE TO RELATED APPLICATION

This is a continuation-in-part of application Ser. No. 13/196,944, filed Aug. 3, 2011, which claims priority, under 35 U.S.C. §119, of German application DE 10 2010 033 140.6, filed Aug. 3, 2010; the application claims priority, under 35 U.S.C. §119, of German application DE 10 2011 080 609.1, filed Aug. 8, 2011; the prior applications are herewith incorporated by reference in their entireties.

BACKGROUND OF THE INVENTION

Field of the Invention

The invention relates to a hearing instrument with an integral injection-molding casing.

By way of example, hearing instruments can be configured as hearing aids. A hearing aid serves to supply a person, who has damaged hearing, with acoustic signals from the surroundings, which have been processed and amplified for compensating for or for treating the respective damage to the hearing. In principle, it consists of one or more input transducers, a signal-processing apparatus, an amplifier apparatus, and an output transducer. The input transducer generally is a sound receiver, e.g. a microphone, and/or an electromagnetic receiver, e.g. an induction coil. The output-signal generator is generally implemented as an electroacoustic transducer, e.g. a miniaturized loudspeaker, or as an electromechanical transducer, e.g. a bone-conduction receiver. It is also referred to as a receiver. The output-signal generator produces output signals that are guided to the ear of the patient and should generate a sense of hearing in the patient. The amplifier is generally integrated into the signal-processing apparatus. The hearing aid is supplied with current by a battery that is integrated into the hearing-aid casing. The essential components of a hearing aid are generally arranged on a printed circuit board as an interconnect device or connected thereto.

Furthermore, hearing instruments could also serve as hearing aids that serve to compensate for a reduced hearing, usually referred to as hearing loss; they can also be embodied as so-called tinnitus maskers. Tinnitus maskers are used for treating tinnitus patients. They generate acoustic output signals that can contribute to reducing bothersome tinnitus or other ear noises affecting the perception and are dependent on the respective hearing impairment and, depending on operating principle, on the surrounding noise as well.

In the following text, the term hearing instrument should be understood to mean hearing aids, tinnitus maskers, and other such instruments.

Hearing instruments often have two-part or multi-part casings that are produced in an injection-molding process. The casings are usually separated along the longitudinal extent thereof. The multi-part casing configuration allows a simple assembly of the interior components. The components can initially be assembled in a first casing part before a further casing part is placed and affixed thereon for sealing and completing the casing. The multi-part casing design moreover ensures larger freedom in design for the casing mold. Although injection-molding methods cannot form undercuts as a matter of principle, undercuts in the overall casing can nevertheless be brought about by virtue of the fact that there is a suitable subdivision into individual casing parts and the indentations that form the undercuts are provided in the individual casing parts (but not as undercuts therein).

A disadvantage of subdivided casings is the increased logistic part complexity because a larger number of casing parts and assembly elements are required. Moreover, the casing separation lines (casing gaps) are susceptible to the ingress of moisture and dirt. Hence, it is of interest to reduce the total length of casing separation lines. This can be achieved by integral casings that merely have as few and as small casing openings as possible. In an integral casing, all interior components of the hearing instrument, in particular the receiver, signal-processing electronics and battery, have to be introduced into the casing through a casing opening, which should be provided for assembly purposes but is as small as possible. By way of example, the interior components including the battery can be introduced through the battery opening in the casing. After the assembly, the battery opening is maintained for inserting and replacing the battery and consequently is required in any case.

A problem in such an assembly consists of fixing the components within the casing. The interior of the casing is no longer readily accessible after the components have been introduced in order, for example, to be able to insert fixation pins or fixation screws. Moreover, as outlined above, it is not possible to provide undercuts in the casing, which undercuts could serve for the fixation. However, fixing is indispensible so that the components do not lie loosely in the casing and are able to move therein, which could cause bothersome noises. Moreover, the components should be prevented from being able to slide out of the casing when the battery compartment is opened for the purpose of replacing the battery.

U.S. Pat. No. 6,959,097 B1 discloses a hearing aid, the casing of which is based on a structure with two casing parts. The interior components are assembled on a plate, referred to as front plate, which forms the first casing part. The second casing part is put over the components and connected to the front plate, for example by screws or a snap-fit connection.

International patent disclosure WO 2006/067133 A1 discloses a hearing aid with a casing into which the interior components preassembled on a frame are inserted through the battery opening. The battery compartment has a battery-compartment cover that can pivot. A pin passes through casing, frame, and battery-compartment cover and serves both as pivot axis for the battery-compartment cover and also for fixing the frame.

Published, European patent application EP 0 288 822 A1 discloses a hearing aid that has both an external casing and an interior casing part, referred to there as a module shell. The interior casing part contains the interior components of the hearing aid. The external casing is fitted to the shape of an auditory canal into which the hearing aid should be inserted.

SUMMARY OF THE INVENTION

It is accordingly an object of the invention to provide a hearing instrument with an integral injection-molding casing which overcome the above-mentioned disadvantages of the prior art methods and devices of this general type.

The object of the invention consists of specifying a fixation for the interior components of a hearing instrument in an integral casing, which is simple in design, production, and assembly; requires few components; and is easy to handle.

According to a basic idea of the invention, a hearing instrument contains a casing and a frame arranged within the casing, wherein the casing has an integral design and surrounds the frame in five spatial directions. In a further spatial direction, the casing has an assembly opening that is dimensioned such that the frame can be pushed into the casing through the opening. In addition to the assembly opening, the casing has a microphone opening in a spatial direction perpendicular to the spatial direction of the assembly opening, which microphone opening interacts with a fixation device, which is arranged on the frame, such that the frame is fixed against sliding out of the casing. This provides a simple fixation mechanism for fixing the frame in the casing. If the microphone opening is formed after the production of the casing, for example as a bore, this results in the option of producing the casing in an injection-molding method because such a fixation mechanism does not require undercuts in the casing, which would be unable to be produced in the injection-molding method. The bore can also be produced by a bar from the outside in the injection-molding tool. The opening subsequently has to be resealed in any case, for example by a microphone cover.

A further advantageous development provides for provision to be made for an elastic device that applies a spring force, directed in the direction of the fixation opening, onto the entire frame. As a result, depending on requirements, this provides securing in addition, or as an alternative, to a bolt with the spring force applied thereon. If a spring force is applied to the entire frame, this secures not only the fixation but the entire frame against movement within the casing. Movements of the frame can cause bothersome noises, e.g. a rattle, which are effectively cut out in a simple fashion by the application of a spring force.

A further advantageous development provides for the fixation opening to be additionally embodied as a microphone opening and the fixation device to be additionally embodied as a microphone receptacle. Since a microphone opening is required in any case, this can reduce the number of casing openings. This further decreases the susceptibility to the ingress of dirt and moisture.

A further advantageous development provides for the frame to be fixed as a result of a mutual engagement between a microphone, inserted into the microphone receptacle, and the microphone opening. The microphone thus so to speak forms the bolt by which the frame is fixed in the casing. It can be provided as an alternative to a bolt or in addition thereto. Since a microphone is required in any case, at least in a hearing aid, this can bring about further securing without further additional component complexity. If a bolt in addition to the microphone is dispensed with, this can bring about a further simplification of the design and a reduction in the design components and, optionally, a reduction in the number of components as well.

A further advantageous development provides for the assembly opening to be configured to serve as a battery opening as well. Since a battery opening is generally required in any case, this results in a further reduction in the number of casing openings. This further reduces the susceptibility to the ingress of dirt and moisture.

In accordance with an added feature of the invention, the fixation device is a microphone and a seal surrounds the microphone in the microphone opening. Additionally, a membrane covers the microphone opening. Optionally, the membrane is disposed in the microphone opening and is supported by the seal. Ideally, the membrane is permeable to sound.

In accordance with a further feature of the invention, there are two microphone openings in the casing and a microphone is disposed in each of the microphone openings. Alternatively, the fixation device is a first microphone disposed in the microphone opening and a second microphone is disposed fully within the casing.

A further basic idea of the invention consists of designing a casing for a hearing instrument such that it can be used in a hearing instrument with the features explained above.

A further basic idea of the invention consists of designing a frame for a hearing instrument such that it can be used in a hearing instrument with the features explained above.

An advantageous development provides for internal components of a signal-processing apparatus of a hearing instrument to be mounted on the frame. This allows a simple and easy preassembly of components onto the frame, without there being impediments by the casing in the process.

Other features which are considered as characteristic for the invention are set forth in the appended claims.

Although the invention is illustrated and described herein as embodied in a hearing instrument with an integral injection-molding casing, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
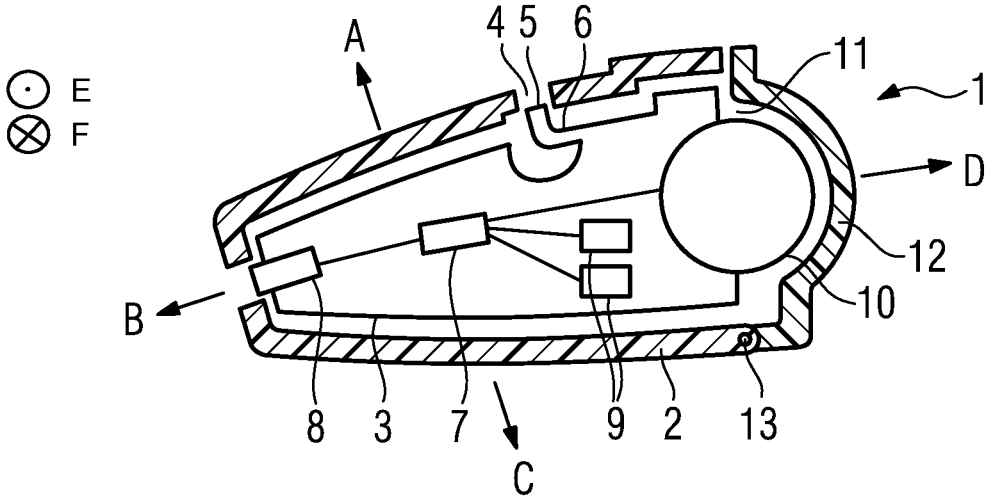
FIG. 1 is a diagrammatic, sectional view of a hearing aid with an elastic bolt according to the invention.

Referring now to the figures of the drawing in detail and first, particularly, to FIG. 1 thereof, there is shown schematically a cross section of a hearing aid 1 with an elastically mounted bolt 5. The hearing aid 1 includes a casing 2 and a frame 3 arranged in the casing 2. Signal-processing components of the hearing aid 1 are arranged on the frame 3, specifically a signal-processing apparatus 7, a receiver 8 and microphones 9. Furthermore, a battery 10 as an energy supply for the signal-processing components is arranged in the casing 2 and electrically connected to the signal-processing apparatus 7 or the frame 3.

An arm 6 is molded onto the frame 3 and, arranged on the arm 6, the bolt 5 is molded on. The arm 6 consists of an elastic material, which can be the same material as used in the frame 3 or can be molded on by a two-component production method. As illustrated in FIG. 1, the arm 6 is shaped such that it makes the bolt 5 engage with a fixation opening 4 of the casing 2, i.e. such that the bolt 5 is introduced into the fixation opening 4.

In the casing 2, the fixation opening 4 is arranged in a spatial direction that is indicated by an arrow denoted by the letter A in the figure for illustrative purposes. Further arrows indicate further spatial directions B, C, D, E, and F. An assembly opening 11 is provided in the casing 2 in spatial direction D, through which the equipped or preassembled frame 3 can be inserted into or pulled out of the casing 2. The assembly opening 11 at the same time serves as a battery-compartment opening, into which the battery 10 is inserted. It is sealed by a battery-compartment cover 12. The battery-compartment cover 12 is mounted in the casing 2 such that it can pivot about an axis 13 and can be opened by pivoting. The battery-compartment cover 12 needs to be opened, on the one hand, for inserting or replacing the battery 10. On the other hand, the frame 3 can be inserted in spatial direction B or pulled out in spatial direction D when the battery compartment is open.

As seen from the assembly opening 11, the casing 2 has no undercuts. Hence the casing 2 can be produced in a simple fashion, for example in a conventional injection-molding method. The fixation opening 4 could in this case be added subsequently, for example as a bore. The fixation opening 4 is provided to fix the frame 3 in the casing 2 in spatial direction D against being pulled out or against unwanted sliding out. To this end, the fixation opening 4 and the bolt 5 mutually engage. FIG. 1 shows that the bolt 5 prevents a movement of the frame 3 in the spatial direction D. In order nevertheless to be able to remove the frame 3, or in order to be able to insert it into the casing 2, the bolt 5 can be pressed toward the frame 3 and away from the fixation opening 4, i.e. in spatial direction C, as a result of its elastic mount. In the process, the bolt is pressed counter to the spring force of the elastic arm 6 and the latter presses the bolt 5 back in spatial direction A as soon as there is no more action from external forces. Hence, when the frame 3 is inserted, the bolt 5 is automatically pressed in the direction of the fixation opening 4 and therefore automatically inserted into the latter. Thus, the fixation is generated automatically when the frame 3 is inserted into the casing 2.

It is possible to see that already one fixation opening 4 suffices to this end and no additional fixation components are required. Moreover, depending on the embodiment of the bolt 5 and the fixation opening 4, the fixation can be released without special tools for the purpose of removing the frame 3 from the casing 2 by simply pressing the bolt 5 through the fixation opening 4.

Figure 2:
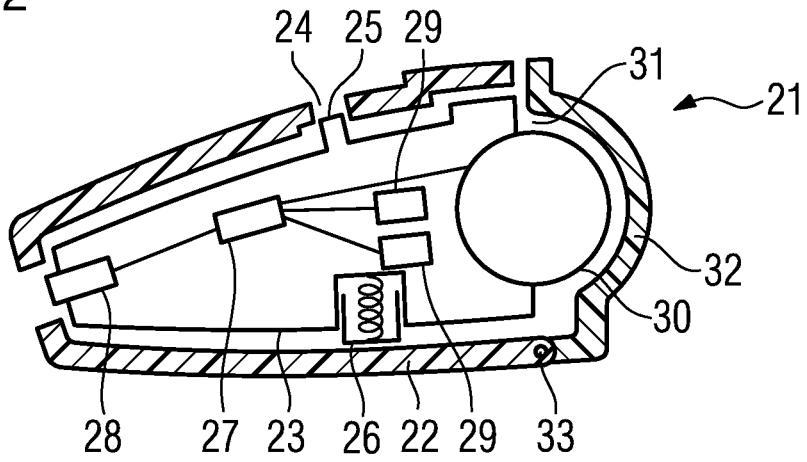
FIG. 2 is a diagrammatic, sectional view of the hearing aid with a spring force applied to a frame.

FIG. 2 schematically illustrates a cross section of a hearing aid 21 with a casing 22 and a frame 23 arranged therein, on which a fixing spring force acts in its entirety. A signal-processing apparatus 27, a receiver 28, and microphones 29 are arranged on the frame 23. A battery 30 is moreover arranged in the casing 22, which battery is electrically connected to the frame 23 or the signal-processing components. It moreover has an assembly opening 31, which, as explained above, is simultaneously configured as a battery-compartment opening. A battery-compartment cover 32 is mounted with an axis 33 in the casing 22 such that it can pivot and at the same time seals the battery compartment and the assembly opening 31.

Furthermore, the casing 22 has a fixation opening 24, which serves to fix the frame 23 in the casing 22. To this end, the bolt 25 and the fixation opening 24 are in mutual engagement. The entire frame 23 including the bolt 25 is pressed in the direction of the fixation opening 24 by a spring mechanism 26. As a result, the fixation is automatically produced and secured because the bolt 25 can only leave the fixation opening 24 by applying an external force against the spring force of the spring mechanism 26. By introducing the bolt 25 into the fixation opening 24, the fixation is thus produced automatically by the spring mechanism 26 when the frame 23 is inserted into the casing 22. In order to remove the frame 23, the frame 23 with the bolt 25 can, as explained above, be pressed against the spring force out of the fixation opening 24 and into the interior of the casing 22 in order to release the fixation in that way.

Figure 3:
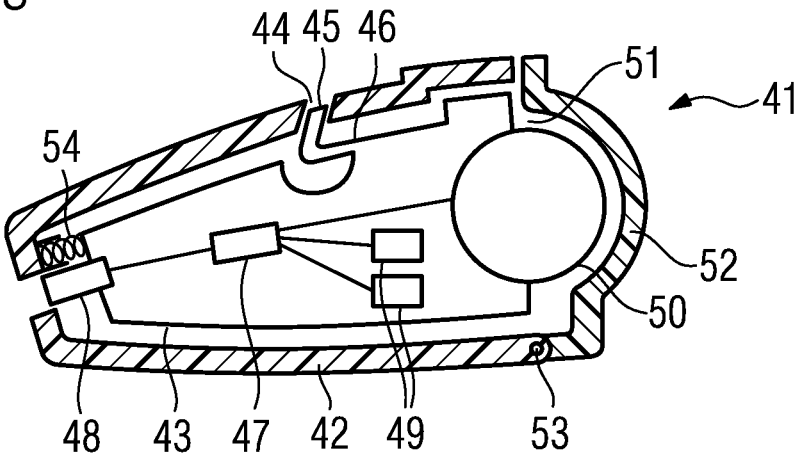
FIG. 3 is a diagrammatic, sectional view of the hearing aid with a bolt embodied as a barb.

FIG. 3 schematically illustrates a cross section of a hearing instrument 41 with a bolt 45 embodied as a barb. As explained above, the hearing instrument has a casing 42 with a battery-compartment cover 52 that can be pivoted about an axis 53. A frame 43 with the signal-processing components of receiver 48, signal-processing apparatus 47, microphones 49, and an attached battery 50 is arranged in the casing 42.

The casing has a fixation opening 44 with an angled profile, fitted to the shape of the bolt 45. It is possible to identify that the angled profile and the corresponding bolt 45 molded at an angle bring about an effect as a barb to the extent that the bolt is forced deeper into the fixation opening 44 as a result of movement of the frame 43 in the direction of the assembly opening 51. The bolt 45 is arranged on an arm 46 and molded onto the frame 43 via the latter. It can have an integral design and be made out of the same material or it can be made from another material and molded on in a two-component design. More particularly, the arm 46 can consist of an elastic material, and so the bolt 45 is guided into the fixation opening 44 or kept therein as a result of the spring force of the elastic arm 46. In order to release the fixation, the bolt 45 can be pressed out of the fixation opening 44 and into the interior of the casing 42 counter to the spring force of the elastic arm 46. However, the arm 46 may also consist of non-elastic material or the bolt 45 need not be arranged on an arm because the embodiment as a barb in any case produces a secure fixation. If the arm 46 is non-elastic, in order to release the fixation, it is merely the entire frame 43 instead of the arm that has to be able to be moved such that the bolt 45 is pushed out of the fixation opening 44 and into the interior of the casing 42. To this end the frame 43 must have enough freedom of movement in the corresponding direction within the casing 42.

The fixation of the frame 43 in the casing 42 is in any case ensured as a result of embodying the bolt 45 as a barb. To this end provision is made for an elastic component, which is embodied as a spring mechanism 54. The latter pushes the frame 43 in the direction of the assembly opening 51. As a result of the mutual engagement as explained above between the bolt 45, embodied as a barb, and the fixation opening 44, the bolt 45 is pressed into the fixation opening 44 as a result of this spring, and hence a secure fixation is ensured. Thus, in order to be able to remove the frame 43 from the casing, a force must initially be applied to overcome the spring force of the spring mechanism 54 and to push the frame 43 further into the casing 42 until the bolt 45 is released.

Figure 4:
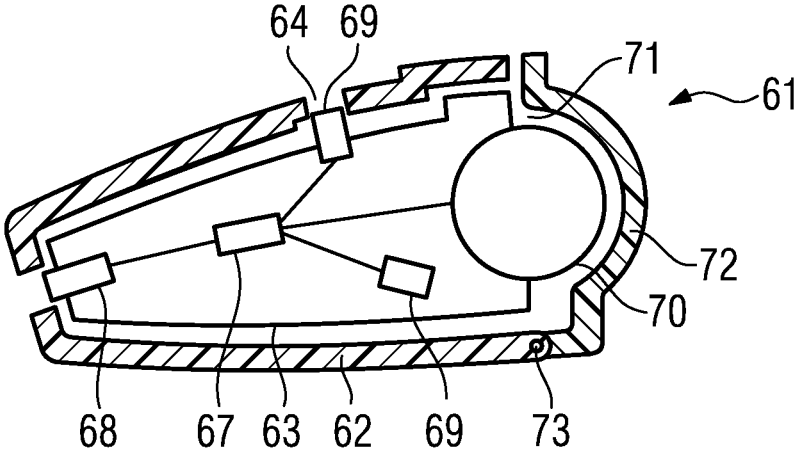
FIG. 4 is a diagrammatic, sectional view of the hearing aid with a microphone acting as the bolt.

FIG. 4 illustrates a hearing aid 61 with casing 62 and frame 63. As explained above, the casing contains a battery-compartment cover 72, mounted about an axis 73, and an assembly opening 71. A fixation opening 64 serves to fix the frame 63 in the casing 62. A battery 70 is arranged within the casing and it is electrically connected to the frame or the components arranged thereon.

A signal-processing apparatus 67, a receiver 68, and a microphone 69 are arranged on the frame 63. The microphone 69 is in mutual engagement with the fixation opening 64. The microphone is assembled on the frame 63 or disassembled therefrom through the fixation opening 64. The mutual engagement between microphone 69 and fixation opening 64, which ensures the fixation of the frame 63 in the casing 62, is created during the assembly of the microphone 69. Thus, during assembly, the frame 63 is pushed into the casing 62 through the assembly opening 71 and the microphone 69 is subsequently assembled on the frame through the fixation opening 64, during which the fixation is produced. In order to remove the frame 63 from the casing 62, the microphone 69 is first removed through the fixation opening 64 and the fixation is released in the process. The frame 63 can thereupon be removed through the assembly opening 71. To (dis)assemble the microphone 69 from the outside would pose particular requirements to the electrical link and connection; by way of example a particularly suitable plug-in connector could be provided for this case.

Figure 5:
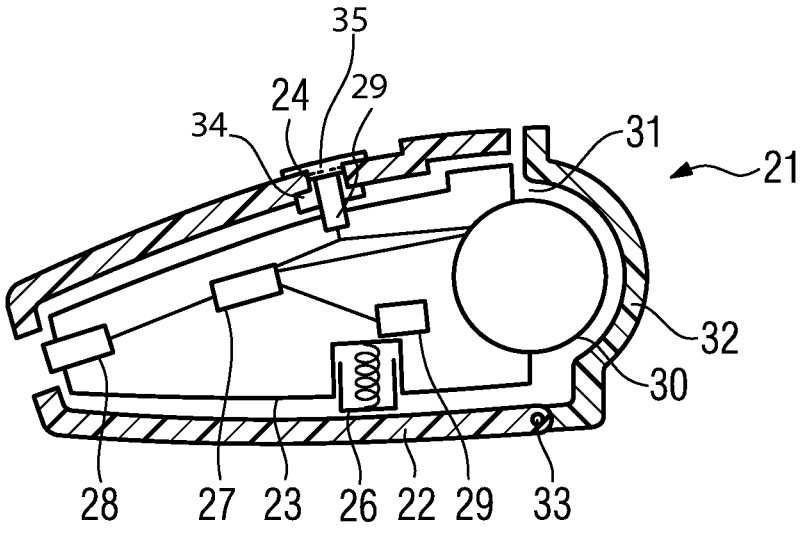
FIG. 5 is a diagrammatic, sectional view of the hearing aid with at least one microphone disposed in a microphone opening and acting as the bolt.

FIG. 5 schematically illustrates a further embodiment of the invention being a variant and combination of the hearing aids illustrated in FIGS. 2 and 4. The hearing aid 21 has the casing 22 with the frame 23 arranged therein, on which a fixing spring force acts in its entirety. The signal-processing apparatus 27, the receiver 28, and the microphones 29 are arranged on the frame 23.

The casing 22 has fixation openings 24, which serves to fix the frame 23 in the casing 22. Only one of the fixation openings 24 is shown in FIG. 5. In FIG. 5, a microphone 29 is disposed in each of the fixation openings 24 or more properly termed microphone openings 24. A seal 34 surrounds each of the microphones 29 to protect the microphones 29 from humidity and contamination from outside the casing 22. A membrane 35 covers the microphone opening 24. The membrane 35 is permeable for sound that needs to reach the microphone. The membrane 35 is shown to lay on top of the casing 22. Alternatively, the membrane 35 could be shortened to be the exact size of the microphone opening 24 and lay on top of the seal 34 and/or the microphone 29 and not on the casing (as shown in dashed lines in FIG. 5).

The entire frame 23 is pressed in the direction of the microphone opening 24 by the spring mechanism 26. As a result, the fixation is automatically produced and secured because the microphone 29 can only leave the microphone opening 24 by applying an external force against the spring force of the spring mechanism 26. By introducing the microphone 29 into the microphone opening 24, the fixation is thus produced automatically by the spring mechanism 26 when the frame 23 is inserted into the casing 22. The spring mechanism 26 applies a force pushing the microphone 29 into the seal 34. By this force, the microphone 29 and the seal 34 are pressed sealingly into the casing 22.

In order to remove the frame 23, the frame 23 with the microphone 29 can, as explained above, be pressed against the spring force out of the microphone opening 24 and into the interior of the casing 22 in order to release the fixation in that way.

In FIG. 5 there is shown an optional positioning of the second microphone 29. Instead of being disposed in a second microphone opening 24, the second microphone 29 is positioned in the casing 22. Of course in this embodiment there is no second microphone opening 24.

A basic idea of the invention can be summarized as follows: The invention relates to a hearing instrument with an integral injection-molding casing. The object of the invention consists of specifying a way of fixing the internal components of a hearing instrument in an integral casing that is simple in design and assembly, requires few components, and is easy to handle. According to the invention, a hearing instrument contains an integral casing 2, 22, 42, 62 and a frame 3, 23, 43, 63 arranged within the casing 2, 22, 42, 62. The casing 2, 22, 42, 62 has an assembly opening 11, 31, 51, 71 through which the frame 3, 23, 43, 63 is pushed into the casing 2, 22, 42, 62. Additionally, the casing 2, 22, 42, 62 has a fixation opening 4, 24, 44, 64 oriented perpendicular to the insertion direction, which fixation opening interacts with a fixation device arranged on the frame 3, 23, 43, 63 in order to fix the frame 3, 23, 43, 63 in the casing 2, 22, 42, 62. This provides a simple fixation mechanism; the fixation opening can be applied as a bore after the production of the casing, and so the casing has no undercuts and can therefore be produced in an injection-molding method. The fixation device can be embodied as a bolt. The bolt can be integrally molded onto the frame. The bolt can be inserted into the fixation opening 4, 24, 44, 64 by a spring force. In one embodiment, a microphone 69 to be assembled after the frame 63 has been inserted into the casing 62 serves as a bolt.

The invention claimed is:

1. A hearing instrument, comprising:

a casing;

a frame disposed within said casing, said casing having an integral design and surrounding said frame in five spatial directions;

a fixation device disposed on said frame; and said casing having in a further spatial direction an assembly opening formed therein dimensioned such that said frame can be pushed into said casing through said assembly opening, said casing further having a microphone opening formed therein in one of the spatial directions perpendicular to the further spatial direction of said assembly opening, said microphone opening interacting with said fixation device disposed on said frame, such that said frame is fixed against sliding out of said casing, said fixation device having a microphone being introduced into said microphone opening and removable from said microphone opening and said microphone being kept therein by a spring force; and an elastic device applying the spring force, directed in a direction of said microphone opening, onto said frame.

2. The hearing instrument according to claim 1, wherein said fixation device is embodied as a microphone receptacle.

3. The hearing instrument according to claim 1, wherein said assembly opening is configured to serve as a battery opening.

4. The hearing instrument according to claim 1, further comprising a seal surrounding said microphone.

5. The hearing instrument according to claim 4, further comprising a membrane covering said microphone opening.

6. The hearing instrument according to claim 4, further comprising a membrane disposed in said microphone opening and supported by said seal.

7. The hearing instrument according to claim 5, wherein said membrane is permeable to sound.

8. The hearing instrument according to claim 1, wherein:

said microphone opening is one of two microphone openings formed in said casing; and said fixation device is one of two fixation devices being microphones, each of said microphones disposed in one of said microphone openings.

9. The hearing instrument according to claim 1, further comprising a second microphone disposed fully within said casing.

10. A casing for a hearing instrument having a frame and a fixation device disposed on the frame, the casing comprising:

a casing body for housing the frame disposed within said casing body, said casing body having an integral design and surrounding the frame in five spatial directions;

said casing body having in a further spatial direction an assembly opening formed therein dimensioned such that the frame can be pushed into said casing body through said assembly opening, said casing body further having a microphone opening formed therein in one of the spatial directions perpendicular to the further spatial direction of said assembly opening, said microphone opening interacting with the fixation device disposed on the frame, such that the frame is fixed against sliding out of said casing body, the fixation device having a microphone being introduced into said microphone opening and removable from said microphone opening and said microphone being kept therein by a spring force; and an elastic device applying the spring force, directed in a direction of said microphone opening, onto said frame.

11. A frame for a hearing instrument having a casing, the frame comprising:

a frame body disposed within the casing, the casing having an integral design and surrounding said frame body in five spatial directions;

a fixation device disposed on said frame body; and the casing having in a further spatial direction an assembly opening formed therein dimensioned such that said frame body can be pushed into the casing through the assembly opening, the casing further having a microphone opening formed therein in one of the spatial directions perpendicular to the further spatial direction of the assembly opening, the microphone opening interacting with said fixation device disposed on said frame body, such that said frame body is fixed against sliding out of the casing, said fixation device having a microphone being introduced into said microphone opening and removable from said microphone opening and said microphone being kept therein by a spring force; and an elastic device applying the spring force, directed in a direction of said microphone opening, onto said frame.

12. The frame according to claim 11, wherein said frame body mounts internal components of a signal-processing apparatus of the hearing instrument.

13. The hearing instrument according to claim 1, further comprising a pivotable cover disposed at said assembly opening for closing said assembly opening.

14. The hearing instrument according to claim 1, further comprising electrical components disposed on said frame.

15. The casing according to claim 10, further comprising a pivotable cover disposed at said assembly opening for closing said assembly opening.

16. The frame according to claim 11, further comprising electrical components disposed on said frame.

* * * * *